United States Patent [19]

Ferrero

[11] 4,271,613

[45] Jun. 9, 1981

[54] EXCAVATOR WITH ARTICULATED ARMS

[75] Inventor: Franca B. Ferrero, Rivoli, Italy

[73] Assignee: Brefer S.p.A., Grugliasco, Italy

[21] Appl. No.: 83,199

[22] Filed: Oct. 10, 1979

[51] Int. Cl.[3] ..... E02F 3/62

[52] U.S. Cl. ..... 37/103; 414/722

[58] Field of Search ..... 37/103, 117.5; 414/722; 60/403

[56] References Cited

U.S. PATENT DOCUMENTS

| | | | |
|---|---|---|---|
| 2,764,306 | 9/1956 | Dorkins | 37/103 |
| 3,441,155 | 4/1969 | Norton | 37/103 X |
| 3,971,215 | 7/1976 | Baron et al. | 60/403 |

*Primary Examiner*—E. H. Eickholt

*Attorney, Agent, or Firm*—Sughrue, Rothwell, Mion, Zinn and Macpeak

[57] ABSTRACT

An excavator with articulated arms has a self propelled truck which rotatably supports a platform. The first arm is articulated by a lateral pivot pin near a peripheral edge of the platform, its pivotal movement about the lateral pivot pin being controlled by a jack itself articulated at one end to the platform near the lateral pivot pin. The opposite end of the jack is articulated to one end of each of a pair of levers, the outer end of one lever being articulated by a common pivot to a central portion of the first arm while the outer end of the second lever is articulated to the platform near the lateral pivot pin. When the platform is substantially horizontal and the first arm is fully raised, the vertical projections of both levers lie within the platform. At the free end of the first arm is articulated one end of the second arm, an excavating member such as a bucket scoop being articulated to the opposite end of the second arm.

5 Claims, 2 Drawing Figures

EXCAVATOR WITH ARTICULATED ARMS

The present invention relates to excavators with articulated arms.

According to the present invention, there is provided an excavator comprising a support truck or trolley; a platform rotatably supported by the support trolley; a first arm articulated at one end about a laterally extending pivot pin supported by the platform in the vicinity of a peripheral edge of the platform; a second arm articulated at one end to the free end of the first arm; an excavating member articulated to the free end of the second arm; and means for controlling the angular movement of said first and second arms of the excavating member about their respective articulations, said control means including means for pivoting the first arm about said lateral pivot pin comprising a jack articulated as one end to the platform in the vicinity of said lateral pivot pin of said first arm two levers both articulated at one end to a common pivot pin to which is also articulated the other end of the jack, the opposite end of one of the two levers being articulated to the platform in the vicinity of said lateral pivot pin of the first arm, and the opposite end of the other of said two levers being articulated to the central portion of the first arm, the arrangement being such that when the platform is substantially horizontal and the first arm is raised to a maximum extent about said lateral pivot pin, the vertical projections of both said two levers are located inside the platform.

Thus the present invention provides an excavator in which the first arm articulated to the platform may be pivoted downwards into a position substantially perpendicular to the platform, using control means which are particularly simple and of quite compact dimensions, in such a way as to enable the excavating member, e.g. a bucket scoop, to operate so as produce deep excavations close to the excavator.

Figure 1:
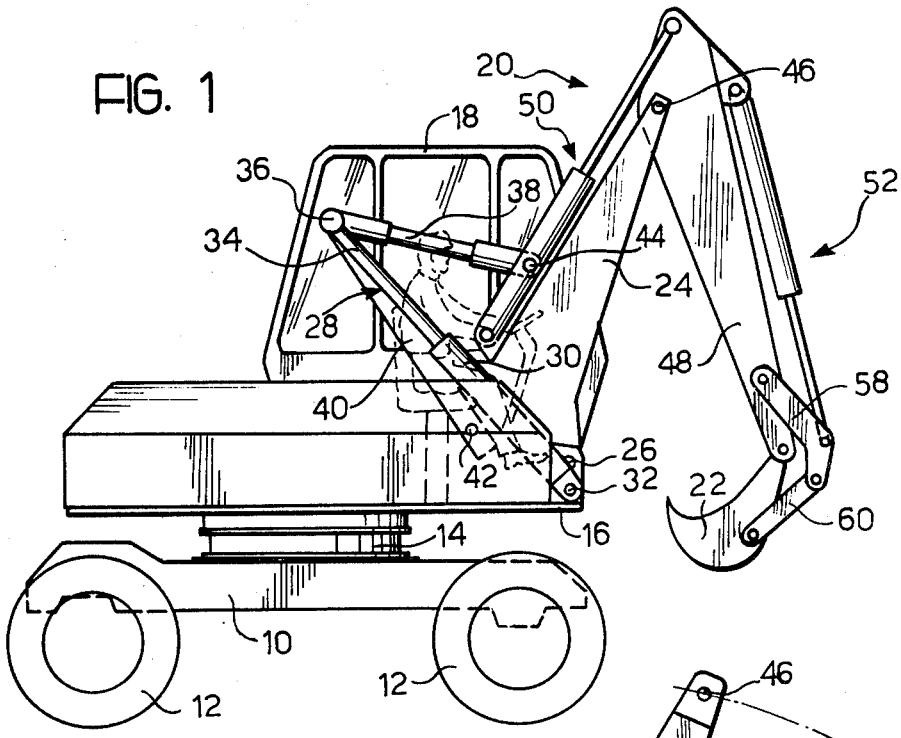
Figure 2:
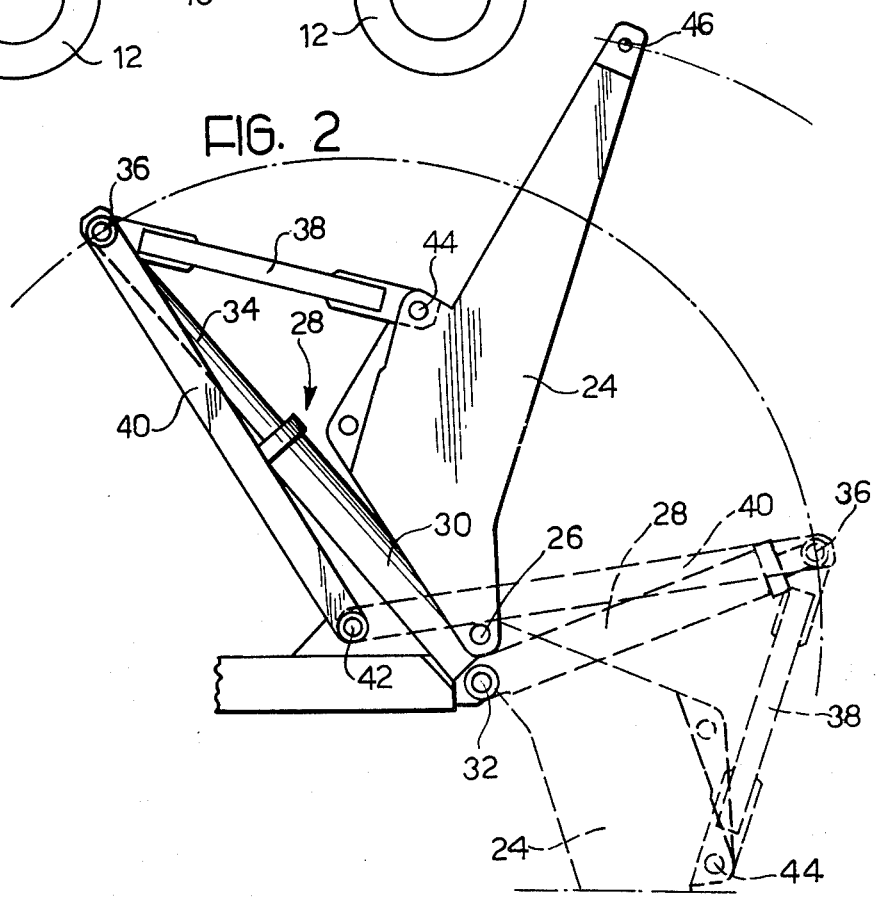

One embodiment of the invention will now be described by way of example, with reference to the accompanying drawings, in which:

FIG. 1 is a diagrammatic view in side elevation of an excavator according to the invention, and FIG. 2 is a diagrammatic view in side elevation and on an enlarged scale of the means for controlling the angular movement of the first arm of the excavator illustrated in FIG. 1.

Referring to the drawings, an excavator according to the invention comprises a self-propelled support truck or trolley 10 mounted on wheels 12. Hydraulic means are provided (not shown in the drawings) which are capable of allowing the track of the excavator to be widened during the excavation operations.

On the support trolley 10 there is mounted a centre plate or pivot 14 which supports a platform 16 which can be rotated in a lateral, usually horizontal plane.

On the platform 16 there are mounted an operating cab 18 and a kinematic mechanism with articulated arms, designated in its entitery by 20, for supporting an excavating member, in this instance a bucket scoop 22.

The kinematic mechanism 20 comprises a first arm 24 articulated at one end to the platform 16 by a horizontal i.e. laterally extending pivot pin 26 which is supported by the platform 16 close to the peripheral edge thereof. The first arm 24 can be controlled so as to pivot about the pin 26 between a first end position (indicated in solid lines in FIGS. 1 and 2), in which the arm 24 is directed upwards, and a second end position (indicated in chain lines in FIG. 2), in which the arm 24 is directed downwards substantially perpendicular to the platform 16.

The control of the angular movement of the first arm 24 is effected by means of a hydraullic jack 28 of which cylinder 30 is articulated to the front edge of platform 16 by a pivot pin 32 arranged adjacent to, below and parallel to the pin 26, the piston rod 34 of the jack 28 being articulated about a pivot pin 36 parallel to pin 32. One end of each of two levers 38, 40 are also articulated about the pin 36. The opposite end of the levers 38 is articulated to the central portion of the pivot arm 24 by a pin 44, parallel to pin 36, whilst the opposite end of lever 40 is articulated to the platform close to pins 26 and 32 by a pin 42 parallel to pins 26, 32. The length of the lever 40 is at least equal, preferably greater than the length of the lever 38. The optimum condition occurs when lever 40 has, as shown in the drawings, a length substantially corresponding to 1.5 times the length of lever 38.

The position of the pin 36 relative to the first arm 24 is such that when the platform is substantially horizontal and the first arm 24 is in its first end position, i.e. the position corresponding to maximum lifting of the first arm 24, the vertical projections of the levers 38, 40 are located inside the platform 16, i.e. the levers 38, 40 is wholly directly above the platform 16. This position of the first arm 24 is achieved when the hydraulic jack 28 is fully extended, whereas the opposite end position of the first arm 24 is achieved when the hydraulic jack 28 is fully retracted.

The free end of the first arm 24 supports a laterally extending pin 46 about which is articulated one end of a second arm 48. This end of the second arm 48 is also articulated to the end of the piston rod of a hydraulic control jack 50, the cylinder of which is articulated to the first arm 24 in the vicinity of the pin 44.

The bucket scoop 22 is articulated to the other end of the second arm 48, the angular displacement of the bucket scoop being controlled by means of a hydraulic control jack 52 whose cylinder is articulated to the second arm 48 in the vicinity of the pin 46, and whose piston rod is articulated to a bell crank lever 58 of which the two arms are respectively articulated to the second arm 48 and to a lever 60 in turn articulated to the bucket scoop 22.

The above-described design of the kinematic mechanism 20 enables the bucket scoop 22 to carry out working strokes of differing configurations, e.g. in the arc of a circle or in a straight line. Moreover, this kinematic mechanism 20, being of compact dimensions enables the bucket scoop 22 to be used for deep excavations even close to the excavator platform.

I claim:

1. An excavator comprising:

a support truck or trolley;

a platform rotatably supported by the support trolley;

a first arm articulated at one end about a laterally extending pivot pin supported by the platform in the vicinity of a peripheral edge of the platform;

a second arm articulated at one end to the free end of the first arm;

an excavating member articulated to the free end of the second arm; and means for controlling the angular movement of said first and second arms and of the excavating member about their respective articulations, said control means including means for pivoting the first arm about said lateral pivot pin comprising a jack articulated at one end to said platform at the front edge thereof adjacent to and directly below said lateral pivot pin of said first arm, two levers both articulated at one end to a common pivot pin to which is also articulated the other end of the jack, the opposite end of one of the two levers being articulated to the platform in the vicinity of said lateral pivot pin of the first arm, and the opposite end of the other of said two levers being articulated to the central portion of the first arm, the arrangement being such that when the platform is substantially horizontal and the first arm is raised to a maximum extent about said lateral pivot pin, the vertical projections of both said two levers are located inside the platform.

2. An excavator as claimed in claim 1, in which the excavating member is a bucket scoop.

3. An excavator as claimed in claim 1 wherein said one of said two levers has a length at least equal to the length of said other of said two levers.

4. An excavator as claimed in claim 3 wherein said one of said two levers has a length greater than the length of said other of said two levers.

5. An excavator as claimed in claim 4 wherein the length of said one of said two levers is about 1.5 times the length of said other of said two levers.

* * * * *